United States Patent [19]

Therond

[11] 4,105,496

[45] Aug. 8, 1978

[54] METHOD AND DEVICE FOR ELECTRONIC CONTROL WITH POSITIVE SAFETY

[75] Inventor: Jean-Paul Therond, Versailles, France

[73] Assignee: Commissariat a l'Energie Atomique, Paris, France

[21] Appl. No.: 638,207

[22] Filed: Dec. 5, 1975

[30] Foreign Application Priority Data

Dec. 11, 1974 [FR] France ..... 74 40769

[51] Int. Cl.[2] ..... G21C 17/00; G06G 7/14

[52] U.S. Cl. ..... 176/19 R; 364/504

[58] Field of Search ..... 176/19 R, 19 EC, 20R, 176/22, 24; 340/146.1 BE; 235/151.3, 193, 151.21; 307/219

[56] References Cited

U.S. PATENT DOCUMENTS

| | | | |
|---|---|---|---|
| 3,425,903 | 3/1969 | Beuilacqua | 176/20 R |
| 3,495,081 | 2/1970 | Mensa | 235/193 |

OTHER PUBLICATIONS

Introduction to Mathematical Statistics, 3rd Ed., Hoel, Wiley & Sons, Inc., pp. 70, 71, 77.

*Primary Examiner*—Samuel W. Engle
*Assistant Examiner*—S. A. Cangialosi
*Attorney, Agent, or Firm*—Sughrue, Rothwell, Mion, Zinn and Macpeak

[57] ABSTRACT

In a method of control of a protection system which is applicable in particular to the initiation of emergency shutdown of a nuclear reactor, N measurements of one or a number of physical parameters are taken and processed by N matching and/or computation units, the median of the N signals corresponding to the N measurements is selected. The signals are obtained at the output of the matching units and the median is compared with a reference value in order to initiate protective action.

6 Claims, 7 Drawing Figures

AC SUPPLY
MONITORING CIRCUIT
DISPLAY
COMPARATOR
RECTIFIER
MEMORY
REFERENCE GENERATOR
VOLTAGE GENERATOR
MEDIANING CIRCUITS
DC/AC CONVERTORS

METHOD AND DEVICE FOR ELECTRONIC CONTROL WITH POSITIVE SAFETY

The present invention relates to an electronic method for positive safety computation which is employed for selecting the median of a series of N quantities and for comparing said median with a reference value.

This invention is also concerned with an electronic control device for the practical application of the method which is primarily employed for emergency shutdown of a nuclear reactor by dropping safety absorbers into the reactor core.

The invention is integrated in particular in the protection system of a nuclear reactor; in this protection system, it is desired to initiate the free fall of safety absorbers within the reactor core when the value of one or a number of physical quantities deviates from a reference value to an appreciable extent. In the application which is concerned with the operation of nuclear reactor control rods, the N physical input quantities are, for example, pressure, temperature or neutron flux, a sample of which is taken at N different points within the reactor.

The extreme precautions which must necessarily be taken in reactor protection systems dictate the need for a very high standard of operational safety and reliability of electronic control devices. It is consequently an advantage to provide control systems which are designed to ensure "intrinsic" positive safety.

The positive safety concept is well known to specialists who are faced with the safety problem; it is understood to mean the ability of a material to undergo a change which tends to initiate the action for which it has been designed in the event of "safe" fault conditions which affect said material. The application to initiation of emergency shutdown of a nuclear reactor is presented by way of example. In the case of industrial materials in common use, the "safe" fault rate is of the same order of magnitude as the "unsafe" fault rate. The device in accordance with the invention has an appreciably reduced unsafe fault rate whereas the safe fault rate remains of the same order of magnitude. Unsafe faults are fault occurrences which do not lead to the desired protection action in the event of overstepping of the threshold value in respect of one of the physical parameters of the protection system. In accordance with the invention, the unsafe fault rate is approximately 100 times lower at absolute value, than that of industrial materials in common use; this result is achieved without any appreciable increase either in the cost or in the dimensions of electronic circuitry.

In more precise terms, the invention is concerned with a method of control of a protection system in particular for a nuclear reactor, in which N measurements of either one or a number of physical quantities are taken and processed by N matching and/or computation units, the median of the N signals corresponding to the N measurements is selected, said signals being obtained at the output of the matching units and the value of the median is compared with a reference value in order that said comparison should initiate the desired protection action.

In general terms, the electronic protection device for the application of the method according to the invention comprises:

N inputs derived from the N matching and/or computation devices which deliver direct-current signals, N direct-current to alternating-current converters, each converter being connected in series with each input and intended to convert the direct-current input signal to a periodic signal having a frequency $f$ and an amplitude which is proportional to the direct-current input quantity, a supply A' which delivers a periodic signal having a frequency $f$ into the N converters by means of an isolation transformer, a median-determination circuit A containing means for selecting the median of the amplitudes of the periodic signals delivered by the converters, a comparator for comparing said value Vm of the amplitude of the median with a predetermined direct-current reference value Vr and delivering by means of an isolation transformer a logical signal +1 when $Vm - Vr > 0$, and 0 when $Vm - Vr < 0$, each of the elements of the device being designed for positive safety.

The N dc/ac converters convert each direct-current voltage to a periodic signal having a frequency $f$ (for example 1 Kc/s), the amplitude of said alternating-current signal being proportional to the direct-current input quantity.

The conversion of direct-current quantities to alternating-current quantities offers a large number of advantages: it permits on the one hand the use of electrical isolation transformers so that, if a fault condition gives rise to failure of one portion of the circuit, the condition does not have any adverse effect on other portions or result in further failures; moreover, alternating-current operation permits continuous testing of the entire device at a frequency which is equal to the frequency of the alternating current.

The method and the device in accordance with the invention are such that the failure of a single element of the circuit automatically results in a safe fault condition whereas only the simultaneous failure of several elements is liable to result in an unsafe fault condition.

Further characteristic features and advantages of the invention will be more clearly brought out by the following description of one exemplified embodiment which is given by way of explanation without any limitation being implied, reference being made to the accompanying drawings, wherein.

In this example of construction, the selected value is $N = 4$. The input quantities correspond for example to the four values of pressure, of neutron flux or of temperature at different points of the nuclear reactor.

Figure 1:
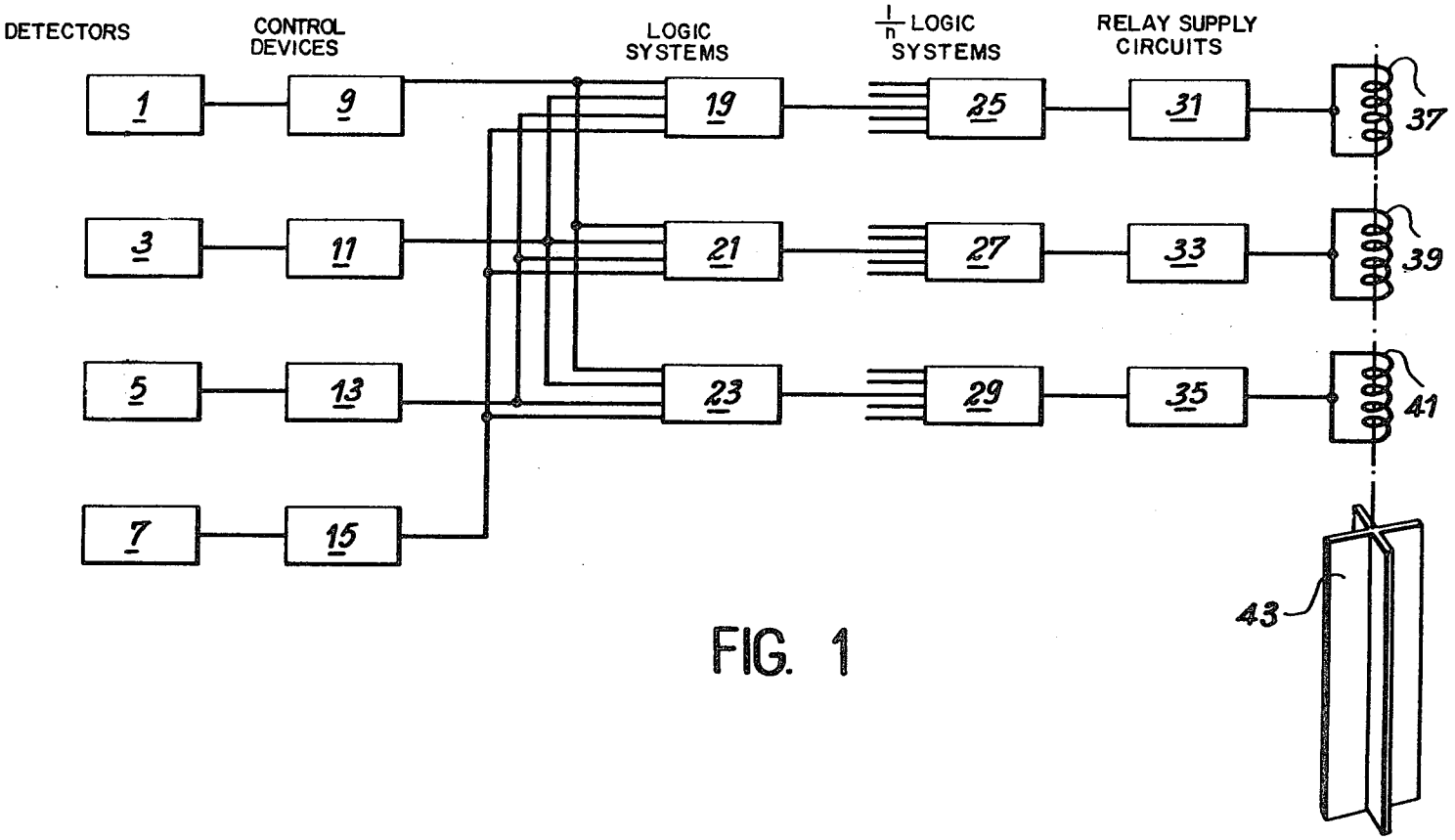
FIG. 1 is a diagram of the device for controlling the safety absorbers of a nuclear reactor which is equipped with the device in accordance with the invention.

There is shown in FIG. 1 a block diagram of the device for controlling safety absorbers in which the control device in accordance with the invention is inserted. There are shown in this figure four detectors 1, 3, 5, 7 for measuring the same physical quantity such as neutron flux, for example. There is placed at the output of each detector a matching or computation unit such as the units 9, 11, 13 and 15. The N signals delivered by said units (four in the case of the figure) are fed into the units 19, 21 and 23 representing the positive-safety control devices according to the invention. Since the units 19, 21 and 23 perform the same function, there is thus a first redundancy of the general device and a safety factor which results from the plurality of the control units.

It will be noted in FIG. 1 that three control units 19, 21, 23 are each connected to four detecting and matching pairs. This makes it possible to disconnect one detecting and matching pair if so desired and to replace this latter by another of the same series for testing or construction purposes. As a rule, only three channels are in fact connected to the units such as the unit 19 (two out of three redundancy). By means of the direct-current logical signals delivered by the control units such as 19, the $1/n$ logic circuits such as the circuits 25, 27 and 29 each produce a trip order. The different inputs of the $1/n$ logic circuits are connected to measuring systems and units for controlling different physical quantities (neutron flux, pressure, temperature and so forth). The output signals of the logic circuits control the relays 31, 33 and 35 for supplying coils 37, 39 and 41. During normal operation, the safety absorber is in the top position, that is, outside the reactor core. When two coils out of three are no longer supplied by the relays, the safety absorber 43 drops and thus permits emergency shutdown of the reactor (two out three redundancy).

Figure 2:
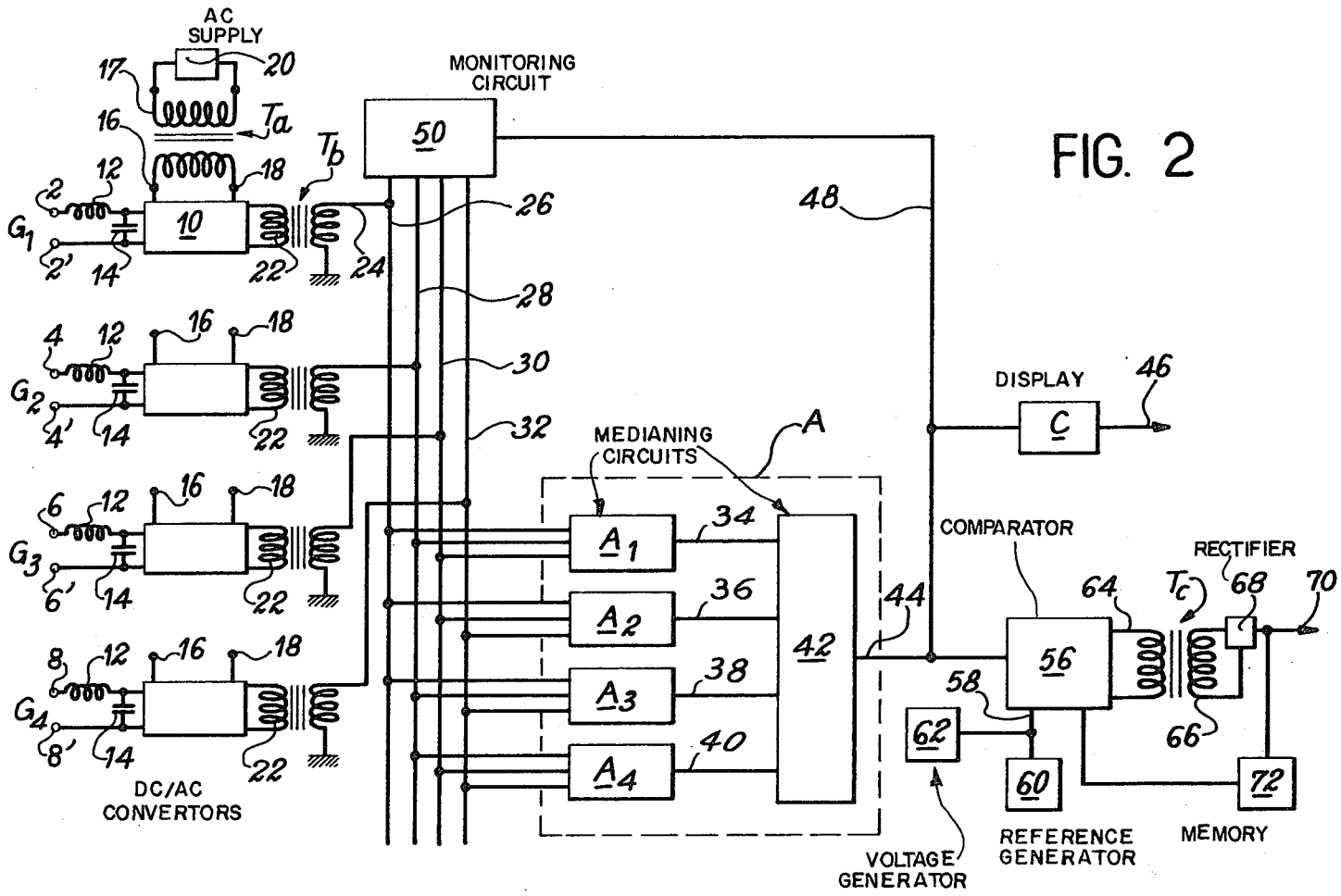
FIG. 2 is a general diagram of the device in accordance with the invention.

There is shown in FIG. 2 a general diagram of the device in accordance with the invention. The direct-current values G1, G2, G3 and G4 are introduced between the terminals 2, 2'; 4, 4'; 6, 6'; 8, 8' and fed into the dc/ac converters such as the converter 10 via a low-pass filter constituted by an inductance coil such as 12 and a parallel-connected capacitor such as 14. The converters such as 10 are supplied by a transformer Ta, the primary winding 17 of which is connected to a supply 20 of alternating current having an amplitude of unity and a frequency of 1 Hz, for example. The terminals such as 16 and 18 of each converter such as 10 are connected to each other through a secondary winding of the transformer Ta which is supplied by the same primary winding 17 connected to the supply 20. The windings such as 22 of the converters such as 10 constitute the primary circuits of the transformers Tb. The output alternating-current voltages having amplitudes proportional to the corresponding input quantity Gi and a frequency equal to the supply frequency of the supply 20 are transmitted to the median-determination circuit A by means of unity transformers such as Tb which have the function of electrical isolation. The transformers Tb have a turns ratio of unity, for example. Alternating-current voltages having an amplitude which is proportional to Gi appear at the secondary windings such as 24. By means of leads 26, 28, 30 and 32, the values of the four input quantities are fed into the median-determination circuit A. Each combination of these four values taken three by three is directed towards the inputs of four circuits A1, A2, A3 and A4. At the output of A2, for example, the upper limit of the values of G1, G3 and G4 appears on the lead 36 during the negative half-wave of the periodic rectangular signal. Similarly, the lower limit of these three values appears during the positive half-wave of the signal.

The circuit 42 has four inputs, namely the input 34 which is connected to the upper limit (in a negative signal) and to the lower limit (in a positive signal) of the values G1, G2, G3, the input 36 connected to the upper/lower limit of the values G1, G3, G4, the input 38 connected to the upper/lower limit of the values G1, G2, G4 and the input connected by the lead 40 to the upper/lower limit of the values G2, G3, G4. The circuit 42 selects the lower limit of these four values in respect of the negative half-wave and the upper limit in respect of the positive half-wave. This lower limit (the high median of the four values) is delivered at 44 in the form of a negative amplitude of voltage having a frequency $f$, namely the frequency of the supply 20. This value of the median is indicated by a circuit C which is electrically isolated with respect to the remainder of the device, the value of the mean being obtained on the cable 46. The median, namely the high median in this case since N is even and equal to 4 is transmitted through the lead 48 into the monitoring circuit 50. The circuit 50 computes the value of the upper median and the values of the upper limit and of the low median of the four input values.

It will be clearly understood that the device of FIG. 2 which is applicable in the case of four inputs can readily be extended to N inputs. In this case, it is possible to calculate in each circuit Ai the upper limit in respect of a half-wave of the input signals (and the lower limit in respect of the half-wave of opposite polarity as shown in the following figures and by virtue of the choice of the type of transistor employed). When N is an odd number, the high and low medians coincide in a single median.

The value of the high median is compared within the block 56 with a reference value introduced by the lead 58 and generated within the block 60; this reference value can be modified by the circuit 62. An isolation transformer Tc is placed at the output 64 of the circuit 56. The value of the alternating-current voltage on the secondary winding 66 of the transformer Tc is rectified by the circuit 68 and transmitted via the lead 70 to the relay circuit of the safety absorbers, for example. The output at 70 has the value +1 when the value of the median is higher than the reference value. In the contrary case and in the event of any fault occurrence in one of the elements of the device according to the invention, the voltage at the output 70 has the value 0. This value initiates the free fall of the safety absorbers of the reactor by means of the relays shown in FIG. 1. A memory or storage device 72 controls the supply of direct-current voltage to the current 56.

The circuit can readily be tested by applying given values of direct-current voltage to the input terminals 2, 4, 6 and 8. This test makes it possible to check the good operation of the entire device as well as the good operation of the detecting devices.

Figure 3:
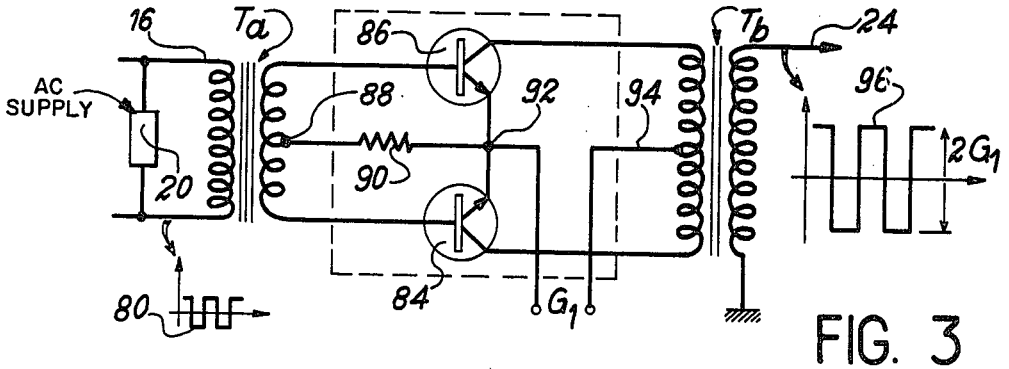
FIG. 3 is an electronic circuit diagram of a dc/ac converter.

There is shown in FIG. 3 the electronic diagram of a dc/ac converter as designated by the reference 10. The supply voltage shown in the diagram 80 is a square-wave voltage having an amplitude of unity. This voltage appears at the primary winding 16 of the transformer Ta. Four converters such as 10 are connected to the secondary winding of said transformer. The converter 10 comprises a secondary winding 82 whose extremities are connected to the bases of the transistors 84 and 86. These two transistors are of the same type, namely of the n-p-n type in the case of the figure. The emitters of these two transistors are connected to each other and to the mid-point 88 of the secondary winding 82 of the transformer Ta through a resistor 90. The voltage G1 is delivered between the point 92 which is connected to the two emitters of the two transistors and the point 94 or mid-point of the primary winding of the transformer Tb. A time-dependent voltage 96 appears on the secondary winding 24 of the transformer Tb. The value of total amplitude of this zero-average alternating-current voltage is double the direct-current value of the input voltage G1.

The operation of this converter is as follows: in the case of one half-wave of the input voltage delivered by the transformer Ta, one of the transistors such as the transistor 84 for example is caused to cut-off whilst the transistor 86 is biased into the conducting state. The voltage which then appears on the primary winding of the transformer Tb is equal to the voltage G1. At the time of the following half-wave of the voltage delivered by the supply 20, the transistor 86 is caused to cut-off and the transistor 84 is caused to conduct. There then appears at the terminals of the primary winding of the transformer Tb a voltage of opposite sign having an amplitude equal to the voltage G1, with the result that the voltage as shown at 96 appears on the secondary winding of the transformer Tb which has a ratio of unity. It can be established that this element provides positive intrinsic safety by reason of the fact that, if one of the transistors is short-circuited as a result of a fault condition, the transformer is saturated by the current G1 and no signal appears on the secondary winding. As will become apparent hereinafter, this absence of signal entails a final output having the numerical value 0.

Figure 4:
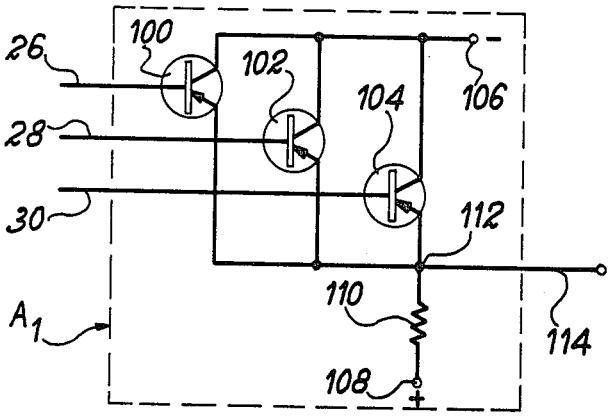
FIG. 4 is the diagram of a circuit Ai in the case of $N = 4$ input values.

There is shown in FIG. 4 a circuit of the Ai type, namely the circuit A1; this circuit comprises three transistors 100, 102 and 104 of the p-n-p type, for example, in which the collectors are connected to a negative voltage terminal 106 and the emitters are connected to a positive voltage terminal 108 through a resistor 110. The three inputs 26, 28 and 30 are connected to the three bases of the three transistors 100, 102 and 104. This circuit is an upper-limit circuit in negative logic. In other words, the value of the lowest voltage on one of the three inputs 26, 28 or 30 governs the voltage of the point 112 since the transistors in which the bases are controlled by a value of the lowest voltage at absolute value are in the non-conducting state. There thus appears on the lead 114 the alternating-current voltage whose negative amplitude is the highest input voltage. It is readily apparent that the three transistors could equally well be of the n-p-n type, in which case the polarities of the voltages at the terminals 106 and 108 must be reversed and the circuit then operates at a positive logical value.

Figure 5:
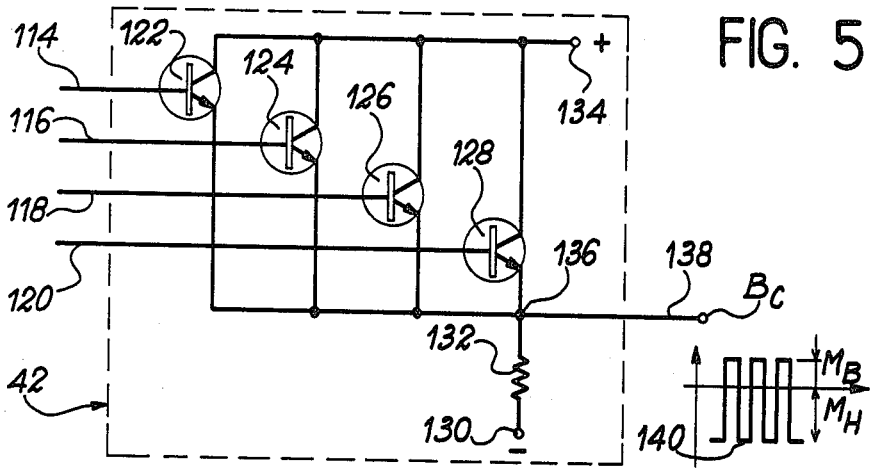
FIG. 5 is a diagram of the circuit for selecting the lower limit of direct-current values, said circuit being connected to the outputs of the circuits Ai.

The circuit 42 which was shown in FIG. 2 and is again shown in FIG. 5 takes the lower limit of the output values of the different circuits Ai. In the case of four input values, the circuit 42 comprises four transistors 122, 124, 126 and 128 which are connected to the outputs such as 114, 116, 118 and 120 of the different circuits A1, A2, A3 and A4. These four transistors are of the n-p-n type, the emitters being connected to a negative voltage terminal 130 through a biasing resistor 132 and the collectors being connected to a positive voltage terminal 134. The point 136 of the circuit is adjusted to the minimum voltage obtained from one of the leads 114, 116, 118 or 120; this voltage biases one of the transistors in the appropriate direction and the three other transistors are in the non-conducting state. There appears on the lead 138 an alternating-current signal whose negative value is equal to the high median (and the positive value is equal to the low median). As in the case of the circuits Ai, it is clearly apparent that the four transistors of the circuit of FIG. 4 could equally well be p-n-p transistors; it would then be necessary in that case to change the polarities of the terminals 130 and 134. The time-dependent variations in the voltage which appears on the lead 138 are shown on the curve 140.

The device as a whole serves to compute the high median and the low median in the case of four inputs. In accordance with the invention and more generally in the case of N inputs, the two medians are computed when N is an even number and the single median is computed when N is an odd number. In the case which is shown in the figure, there are carried out four combinations ($x = 4$) A1, A2, A3 and A4 of four inputs taken three by three.

In more general terms, the number of combinations of N inputs taken from $(N + 1)/2$ to $(N + 1)/2$ when N is odd-numbered for example and equal to:

$$x = \text{number of combinations} = \frac{N!}{\frac{N+1}{2}!\,\frac{N-1}{2}!} = \text{number of circuits}$$

$Ai,\ i = 1,2, \ldots x$
and when N is even-numbered $$X = \frac{N!}{(\frac{N}{2}+1)!\,(\frac{N}{2}+1)!}$$

It is readily demonstrated that these combinations make it possible to compute the medians. The circuit A or so-called median-determination circuit performs the following operation: in the case of N even-numbered and equal to 4, there is computed on a half-wave corresponding to negative values of the signals the high median MH of four quantities G1, G2, G3, G4 by means of the formula:

MH = MIN [MAJ (G1, G2, G3), MAJ (G1, G2, G4), MAJ (G1, G3, G4), MAJ (G2, G3, G4)]

where MIN designates the lower limit and MAJ designates the upper limit. By means of the device described earlier, the low median is computed on the other half-wave corresponding to positive values.

MB = MAJ [MIN (G1, G2, G3), MIN (G1, G2, G4), MIN (G1, G3, G4), MIN (G2, G3, G4)]

In the output of each of the circuits Ai or in other words on the emitter of each transistor of any one circuit Ai, there is again found the upper limit on the negative half-wave and the lower limit on the positive half-wave of the $y$ input values. There appears on the ouput terminal Bc of the median-determination circuit A a periodic signal having a minimum value equal to the high median MH and a maximum value equal to the low median MB.

Figure 6:
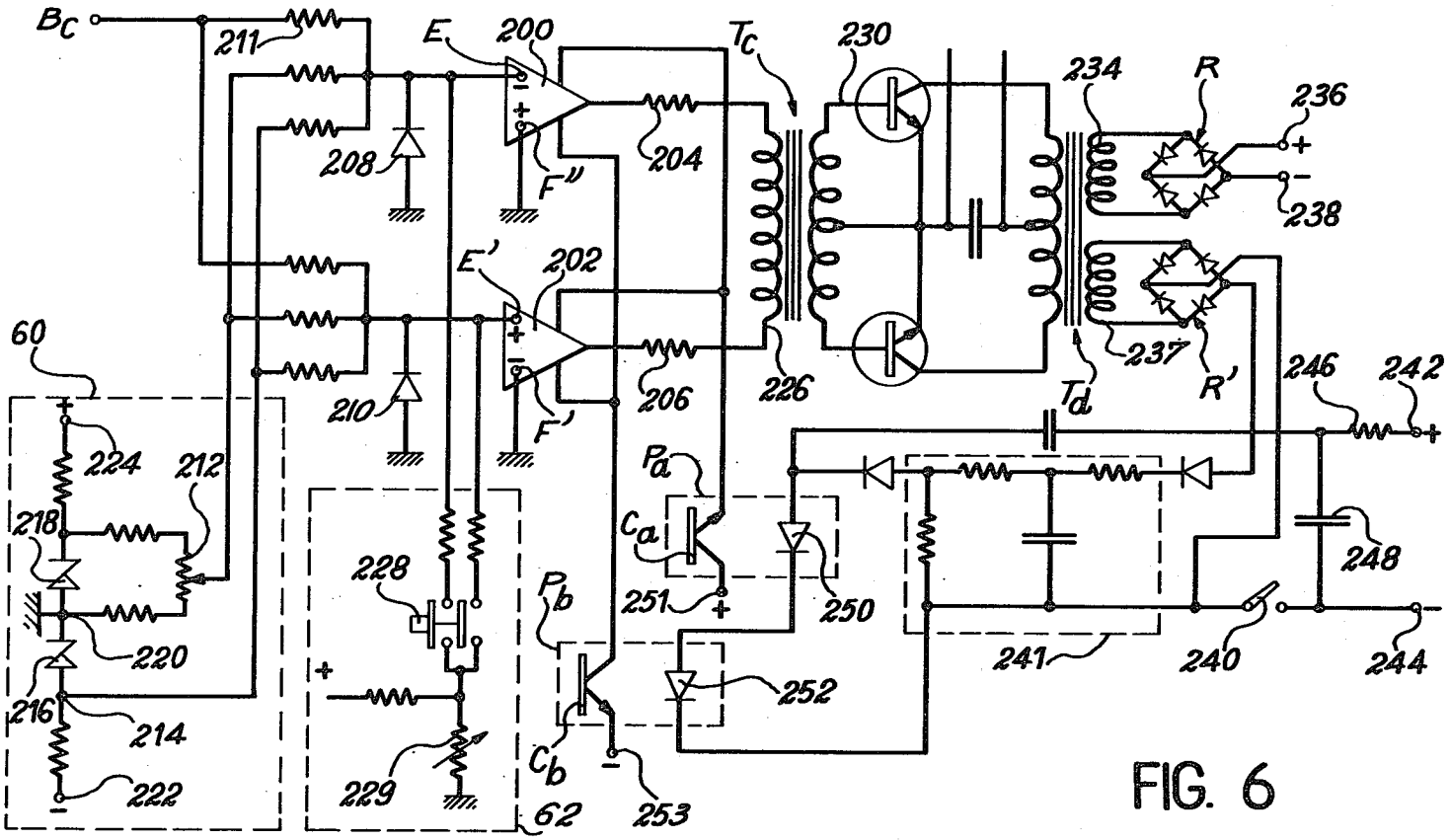
FIG. 6 is a circuit diagram of the electronic comparator system.

The comparator circuit in accordance with the invention is shown in FIG. 6. This circuit compares the alternating-current value of the voltage which appears on the terminal Bc with a reference direct-current voltage.

The circuit comprises two differential comparators 200 and 202, the outputs of which are connected to the extremities of the primary winding of the transformer Tc through resistors 204 and 206. The inputs F and F' of these two differential amplifiers are connected to ground. The diodes 208 and 210 short-circuit the positive values which appear on the inputs E and E'. By means of resistors such as the resistor 211, the alternating-current values of the voltages which appear on the terminal Bc and a reference direct-current voltage are introduced to the inputs E and E'. The reference direct-current voltage Vr is formed from two voltages of opposite sign which appear at the points 212 and 214. The diodes 216 and 218 are Zener diodes and the point 220 is connected to ground. A direct-current voltage source delivers a negative voltage to the terminal 222 and a positive voltage to the terminal 224. The voltage appearing at the point 214 is fixed whereas the voltage appearing at the point 212 is adjustable.

The voltage which appears at 214 is the fixed shift voltage Vd and the adjustment voltage Va at 212 added to the fixed voltage Vd at 214 constitutes the reference voltage Vr. The combination of these two voltages results in a logical level 0 at the output of the comparator (positive safety circuit) in the event of failure of one of said voltages. The voltage which appears at 214 is of the order of three times the amplitude of the voltage of the high median which appears at Bc and the voltage 212 is of the order of twice this value. By difference, there thus appears on the input E an adjustable direct-current voltage of the order of the high median.

Figure 7:
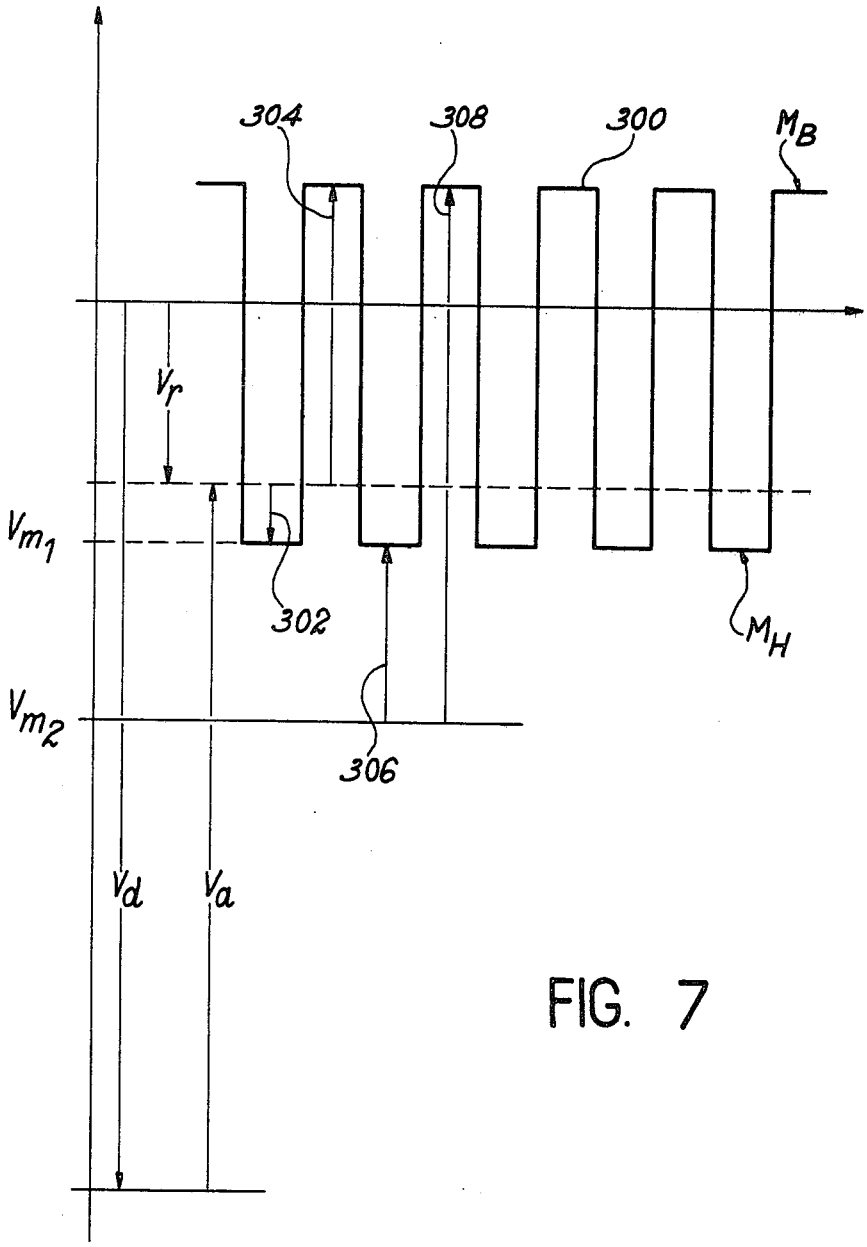
FIG. 7 is a diagram of the different electrical signals employed in the operation of the comparator.

When the value of the reference voltage is lower than the high median as shown in FIG. 7, the differential amplifiers oscillate on each side of a zero average value at a frequency of 1 Kc/s. There therefore takes place a power transfer from the upstream to the downstream side and a voltage appears at the secondary 230 of the transformer Tc. When the reference value is higher at absolute value than the amplitude of the high median, the polarity of the signal introduced into the differential amplifier does not change and the operation is performed on that portion of the hysteresis curve of the transformer Tc which corresponds to negligible variations of the magnetic induction B. No signal appears at the secondary 230, thereby resulting in a level 0 of the output signal.

The circuit 62 makes is possible to vary the value of the reference voltage to a slight extent by producing action on the push-button 228 and the resistor 229. By means of said push-button, the comparator is tripped and this serves to detect a possible drift in the trip threshold. It can easily be ascertained that, if the signal which arrives on the terminal Bc is not an alternating-current signal, no signal is transmitted to the secondary winding of the transformer Tc and the output signal consequently has a value of 0, with the result that the upstream portion of the terminal Bc provides intrinsic positive safety.

Similarly, the circuit 60 is such that, if a Zener diode is damaged, the voltage applied to the inputs is such that the transformer Tc is saturated and that the output signal at 230 is zero. The block 60 provides intrinsic positive safety.

To summarize, an alternating-current signal appears on the secondary winding 230 of the transformer Tc when the high median is lower than the reference value. In the alternative embodiment shown in FIG. 6, said signal is amplified by two transistors mounted in opposition and supplied by a storage battery (not shown). A transformer Td provides electrical isolation; the secondary winding of said transformer Td is connected to a rectifier R of the conventional bridge type with four diodes. When an alternating-current voltage appears at the secondary 234 of the transformer Td, a positive direct-current voltage appears between the terminals 236 and 238 of the four-diode bridge rectifier R. No voltage appears in the event of failure of an element or if the reference value is higher than the high median. The circuit in accordance with the invention also comprises a memory circuit for controlling differential amplifiers 200 and 202. This circuit is connected to the secondary winding 237 of the transformer Td; the alternating-current voltages are rectified to produce direct-current voltages by means of a rectifier R'. These direct-current voltages serve to supply two photo-couplers Pa and Pb by means of the conventional delay circuit 241.

A switch 240 serves to connect the supply of the photo-couplers Pa and Pb to a voltage source which is in turn connected to the terminals 242 and 244 by means of a delay circuit comprising a resistor 246 and a capacitor 248, the time constant RC being of the order of one second, for example. The photo-couplers Pa and Pb are each constituted by a photo-receiver such as Ca and a photo-emitter such as 250. The photo-receivers connect the differential amplifiers to two voltage terminals 251 and 253 which are respectively positive and negative; it is only when these photo-receivers are in the conducting state or in other words when they are illuminated that the differential amplifiers are supplied with voltage.

When no signal appears at the secondary of the transformer Tc, no signal is re-transmitted to the secondary of the transformer Td and the supply of the differential amplifiers is no longer effected. During normal operation, when the rectifier R' is supplied, the current passes through the photodiodes such as 250 which direct the light into the photoconductors such as Ca, with the result that these latter are triggered into conduction and that the differential amplifiers 200 and 202 are supplied. In order to reinitiate a measurement in the event of dropping of the control rods caused by the output value 0, it is possible to operate the switch 240 which discharges the capacitor 248 and this discharge supplies the photodiodes 250 and 252.

Although it has not been explained in the case of all the elements, it can readily be ascertained that any failure of one of the elements of the general device shown in FIGS. 2 to 6 results in an output value 0 of the comparator.

FIG. 7 shows a detailed diagram of operation of the comparator which is illustrated in FIG. 6. The signal 300 of rectangular waveform is the signal which appears on the terminal Bc after the median-determination circuit A. This signal is compared with the sum of two voltages, namely the shift voltage Vd of fixed value which appears at 214 in FIG. 6 and the adjustment voltage Va which is adjusted by the potentiometer 212 and is of opposite sign. The reference voltage Vr is equal to the algebraic sum of these two voltages; the voltages Vd and Va are of the order of two to three times the maximum value of the median which has the value Vm.

When the voltage $Vm_1$ is higher at absolute value than the reference value as is the case in the figure, the voltage applied to the inputs E and E' is alternately positive and negative as shown by the arrows 302 and 304, the transformer Tc is not saturated and a signal appears at the secondary 230 (as shown in FIG. 6). This corresponds to good operation of the system and a final output logical value of +1. On the contrary, when $Vm_2 > Vr$, the transformer Tc is saturated since the voltages are always of the same sign at the input E (arrows 306 and 308) and the final output logical value is 0. The values chosen for the voltages Vd and Va are considerably higher than Vm in order to ensure that, in the event of failure of one of the supplies which deliver these two voltages, this does not automatically result in saturation of the transformer Tc.

It is wholly apparent that the present invention is not limited to the embodiment described by way of example in the foregoing but extends on the contrary to all alternative forms which remain within the definition of equivalent means, especially for carrying out the different functions of comparison and computation of the mean value in the condition of positive intrinsic safety.

What I claim is:

1. An electronic device for positive safety control which serves to carry out a method of control of a protection system, in particular for a nuclear reactor, in which N measurements of either one or a number of physical quantities are taken and processed by N matching and/or computation units, wherein the median of the N signals corresponding to the N measurements is selected, said signals being obtained at the output of said units, and wherein the value of the median is compared with a reference value so that the comparison initiates the desired protection action, and wherein said device comprises:

N inputs derived from the N matching and computation devices which deliver direct-current signals, N direct-current to alternating-current converters, each converter being connected in series with each input for converting the direct-current input signal to a periodic signal having a frequency *f* and an amplitude which is proportional to the direct-current input quantity, a supply A' which delivers a periodic signal having a frequency f into the N converters by means of an isolation transformer, an alternating current median-determination circuit A containing means for selecting the median of the amplitudes of the periodic signals delivered by the converters, and an alternating current comparator for comparing said value Vm of the amplitude of the median with a predetermined direct-current reference value Vr and delivering by means of an isolation transformer a logical signal +1 when $Vm - Vr > 0$, and 0 when $Vm - Vr < 0$, each of the elements of the device being designed for positive safety.

2. A device according to claim 1, wherein the median determination circuit A which selects the low median when the input signals are positive and the high median when the input signals are negative comprises:

*x* identical circuits Ai which select the upper limit of the input signals when said input signals are positive and the lower limit when said input signals are negative, *x'* being equal to the number of combinations of the N inputs which are combined in groups of (N + 1)/2 when N is odd-numbered and in groups of (N/2) + 1 when N is even-numbered, each of the circuits Ai being provided with *y* transistors, where *y* is equal to (N + 1)/2 when N is odd-numbered and (N/2) + 1 when N is even-numbered, the base of each of the *y* transistors of the same type being connected to the secondary winding of the transformers Tb, the collectors of said *y* transistors being connected to a negative-voltage terminal and the emitters being connected to a positive-voltage terminal through a resistor, a circuit B which selects the lower limit of the input signals when said signals have positive values and the upper limit of the input signals when said signals have negative values, said circuit B being constituted by *x* transistors of the same type in opposition to the *y* transistors of the circuits Ai in which each base is connected to the common emitters of the *y* transistors of one and the same circuit Ai, the collectors of said *x* transistors being connected to a positive-voltage terminal and the emitters being connected to a negative-voltage terminal through a resistor, an output connected directly to the emitters of the *x* transistors.

3. A device according to claim 2, wherein the median determination circuit A comprises *x* circuits Ai constituted by *y* transistors of the n-p-n type, the *x* transistors of the circuit B being of the p-n-p type.

4. A device according to claim 1, wherein the comparator comprises two differential amplifiers having outputs connected to the extremities of the primary winding of a transformer Tc and each having a positive input and a negative input, each of these two inputs, namely the positive input in one of the amplifiers and the negative input in the other amplifier, being connected:

to the output of the median-determination circuit A which delivers an alternating-current signal, to a shift direct-current voltage source having a fixed value, to an adjustment direct-current voltage source Va, the two other inputs of the two differential amplifiers being connected to ground, and wherein the comparator also comprises an isolation transformer followed by a power amplifying stage consisting of transistors and transformers, the secondary windings of said transformers being connected to rectifiers which deliver at the output direct-current logical signals.

5. A device according to claim 4, wherein said device comprises a memory circuit composed of two photocouplers Pa and Pb, each photo-coupler being composed of a photo-emitter and of a photo-receiver, the photo-receiver Ca being such as to connect a positive voltage supply terminal to two differential amplifiers and the photo-receiver Cb being such as to connect a negative voltage supply terminal to the two differential amplifiers and the two photodiodes being supplied in parallel by a voltage obtained from one of the rectifiers and by a direct-current voltage obtained from a storage battery which is connectable by means of a resetting push-button.

6. The device according to claim 1 in combination with a nuclear reactor including a controllable device for dropping safety absorbers into the reactor core, wherein the N input values are a sample of a single physical parameter to be monitored, and wherein the output of the comparator controls the device for dropping safety absorbers into the reactor core.

* * * * *